US012398617B1

(12) United States Patent
Ejim

(10) Patent No.: US 12,398,617 B1
(45) Date of Patent: Aug. 26, 2025

(54) GAS-ACTIVATED VENT VALVE BELOW PACKER FOR STABLE ELECTRICAL SUBMERSIBLE PUMP (ESP) OPERATION IN GASSY WELLS

(71) Applicant: SAUDI ARABIAN OIL COMPANY, Dhahran (SA)

(72) Inventor: Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/589,161

(22) Filed: Feb. 27, 2024

(51) Int. Cl.

| | |
|---|---|
| ***E21B 34/08*** | (2006.01) |
| ***E21B 33/122*** | (2006.01) |
| ***E21B 43/12*** | (2006.01) |
| ***E21B 43/38*** | (2006.01) |

(52) U.S. Cl.
CPC ..... *E21B 34/08* (2013.01); *E21B 33/122* (2013.01); *E21B 43/128* (2013.01); *E21B 43/38* (2013.01)

(58) Field of Classification Search
CPC ..... E21B 34/08; E21B 33/122; E21B 43/128
See application file for complete search history.

(56) References Cited

U.S. PATENT DOCUMENTS 2,955,612 A 10/1960 Moser
6,135,210 A * 10/2000 Rivas ..... E21B 43/38 166/66.4
9,829,894 B2 11/2017 Hagen
2005/0047940 A1 3/2005 Nawa et al.
2008/0245525 A1* 10/2008 Rivas ..... E21B 43/128 166/105.5

(Continued)

FOREIGN PATENT DOCUMENTS

DE 102005057004 B3 4/2007
GB 2159854 A 12/1985

OTHER PUBLICATIONS

"Novomet: Safely Vent Gas Below the Packer Into the Annulus;" Accessed Feb. 27, 2024; Product Guide for Annular Gas Vent Valve; Retrieved from the Internet: URL: <https://www.novometgroup.com/products-services/well-completions/flow-control/annular-gas-vent-valve/index.html> (6 pages).

(Continued)

*Primary Examiner* — David Carroll
(74) *Attorney, Agent, or Firm* — Osha Bergman Watanabe & Burton LLP

(57) ABSTRACT

A system includes a packer sealed against a casing string deployed in the well, production tubing extending through the packer and configured to transport the production fluids to a surface location, and an electric submersible pump connected to the production tubing at a location downhole from the packer. The electric submersible pump is configured to pump the production fluids through the production tubing. The system further comprises a gas activated vent valve installed on the production tubing at a location downhole from the packer and configured to open using a pressure exerted on the gas activated vent valve by the gas and a vent line connected to an outlet of the gas activated vent valve, extending through the packer, and configured to transport the gas from the gas activated vent valve to the surface location when the gas activated vent valve is opened by the gas.

20 Claims, 6 Drawing Sheets

(56) References Cited

U.S. PATENT DOCUMENTS

| | | | | |
|---|---|---|---|---|
| 2009/0211753 | A1* | 8/2009 | Emtiazian | E21B 43/13 166/250.03 |
| 2010/0089588 | A1* | 4/2010 | Thompson | E21B 43/38 166/372 |
| 2011/0132595 | A1 | 6/2011 | Rivas et al. | |
| 2018/0038214 | A1* | 2/2018 | Collins | E21B 43/38 |
| 2021/0148202 | A1 | 5/2021 | Al-Gouhi et al. | |

OTHER PUBLICATIONS

"Nova: Gas Lift Valves;" Accessed Feb. 27, 2024; Product Brochure for Schlumberger Gas Lift; Retrieved from the Internet: URL: <https://www.slb.com/-/media/files/al/product-sheet/nova-ovv-ps.ashx> (2 pages).

International Search Report issued in corresponding International Application No. PCT/US2025/016992; mailed May 20, 2025 (5 pages).

Written Opinion of the International Searching Authority issued in corresponding International Application No. PCT/US2025/016992; dated May 20, 2025 (5 pages).

* cited by examiner

GAS-ACTIVATED VENT VALVE BELOW PACKER FOR STABLE ELECTRICAL SUBMERSIBLE PUMP (ESP) OPERATION IN GASSY WELLS

BACKGROUND

Hydrocarbons are located in porous rock formations beneath the Earth's surface. Wells are drilled into these formations to produce the hydrocarbons. Most wells have a variation of downhole equipment, such as Electrical Submersible Pump (ESP) systems, installed to help with the production of hydrocarbons. Specifically, ESP systems include a downhole pump that pumps the hydrocarbons from the interior of the well to a surface location. The hydrocarbons being produced are often a mixture of fluids, including associated gas. As such, ESP systems may be equipped with a gas separator that separates the associated gas from the other fluids prior to the produced hydrocarbons being pumped to the surface. The associated gas is often vented into the annulus of the well and accumulates beneath the packer. Further, the associated gas may naturally separate from the liquid hydrocarbons and may also rise to accumulate beneath the packer.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for venting gas separated from production fluids located in a well. The system includes a packer sealed against a casing string deployed in the well, production tubing extending through the packer and configured to transport the production fluids to a surface location, and an electric submersible pump connected to the production tubing at a location downhole from the packer. The electric submersible pump is configured to pump the production fluids through the production tubing. The system further comprises a gas activated vent valve installed on the production tubing at a location downhole from the packer and configured to open using a pressure exerted on the gas activated vent valve by the gas and a vent line connected to an outlet of the gas activated vent valve, extending through the packer, and configured to transport the gas from the gas activated vent valve to the surface location when the gas activated vent valve is opened by the gas.

The method includes sealing a packer against a casing string deployed in the well, wherein the packer comprises production tubing disposed therein, pumping the production fluids through the production tubing to a surface location using an electric submersible pump connected to the production tubing at a location downhole from the packer, opening a gas activated vent valve installed on the production tubing at a location downhole from the packer using a pressure exerted on the gas activated vent valve by the gas separated from the production fluids, and venting the gas to the surface location using a vent line connected to an outlet of the gas activated vent valve and extending through the packer when the gas activated vent valve is opened by the gas.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
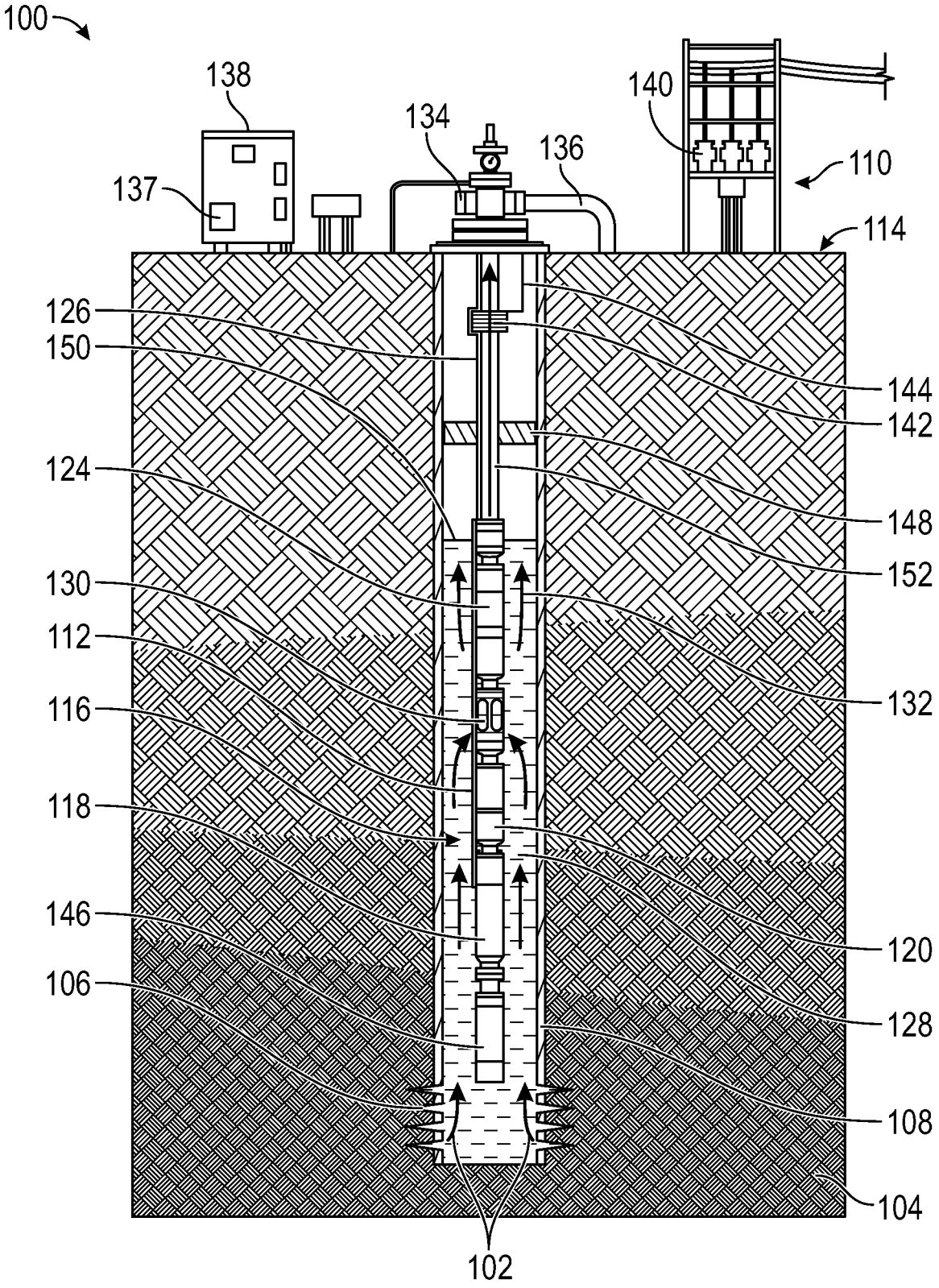
FIGS. 1 and 2 show ESP systems in accordance with one or more embodiments.
Figure 2:
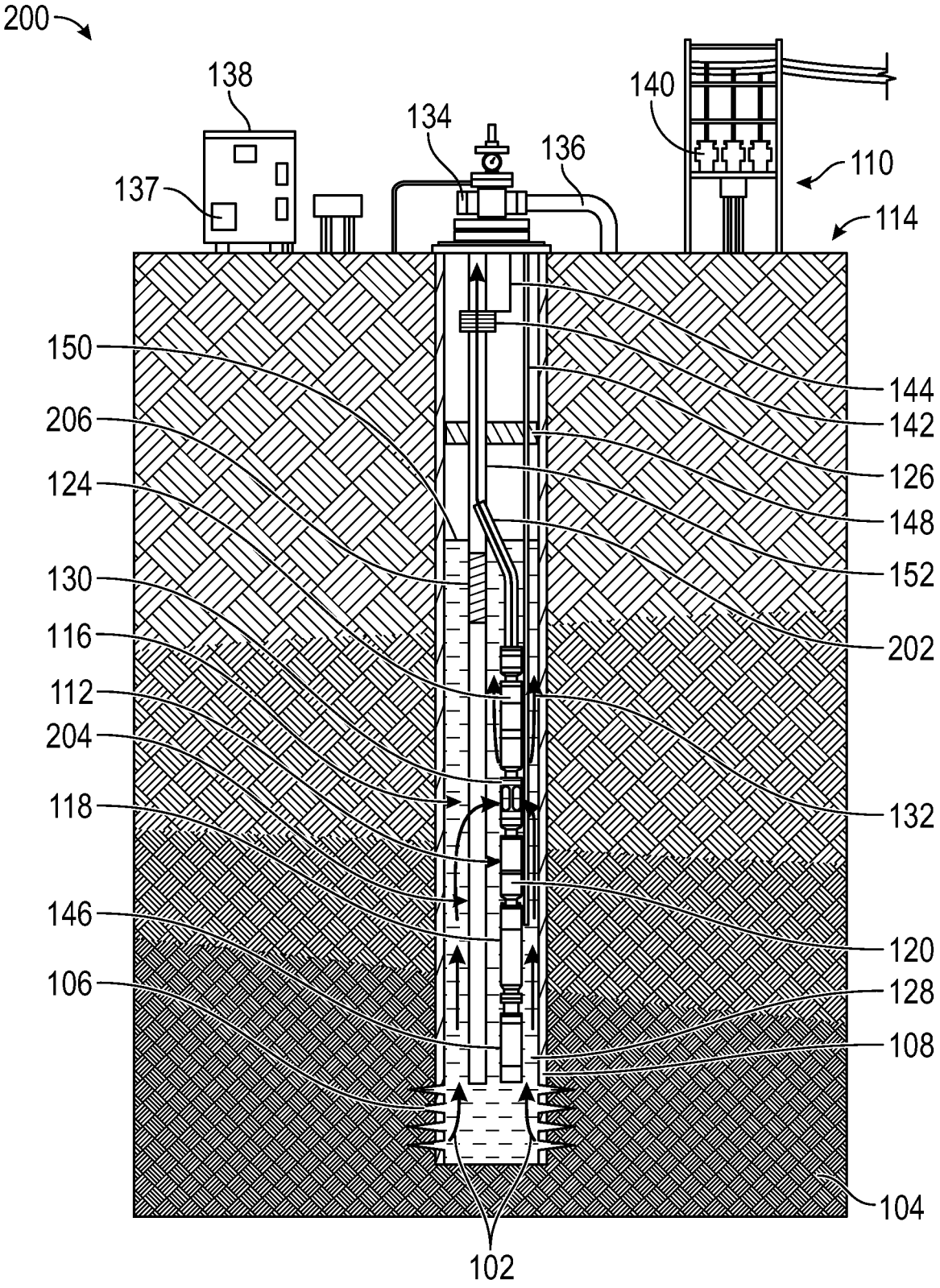

FIGS. 1 and 2 show ESP systems (100, 200) in accordance with one or more embodiments. The ESP systems (100, 200) shown in FIGS. 1 and 2 is for example purposes only and any ESP system (100, 200) configuration may be used without departing from the scope of the disclosure herein. Specifically, FIG. 1 shows an ESP system (100) with no bypass and FIG. 2 shows an ESP system (200) with a bypass, further outlined below.

The ESP system (100, 200) is used to help produce produced fluids (102) from a formation (104). Perforations (106) in the well's (116) casing string (108) provide a conduit for the produced fluids (102) to enter the well (116)

from the formation (104). The produced fluids (102) may include any fluid located in the formation (104) that migrates from the formation (104) into the well (116). The produced fluids (102) may have any make up known in the art. For example, the produced fluids (102) may include hydrocarbons and brine. The hydrocarbons may be a mixture of oil and gas without departing from the scope of the disclosure herein. The ESP system (100, 200) includes surface equipment (110) and an ESP string (112). The ESP string (112) is deployed in a well (116) and the surface equipment (110) is located on the surface (114). The surface (114) is any location outside of the well (116), such as the Earth's surface.

The ESP string (112) may include a monitoring sub (146), a motor (118), a protector (120), a pump (124), an electrical cable (126), a packer (148), a sub-surface safety valve (SSSV) (142), and a SSSV control line (144). The ESP string (112) may also include various pipe segments, called production tubing (152), of the same or different lengths to connect the components of the ESP string (112).

The monitoring sub (146) may include various sensors that may be used to monitor wellbore conditions and the flow of produced fluids (102). For example, the monitoring sub (146) may include temperature and pressure sensors (not pictured) that measure the temperature and pressure of the well (116). The monitoring sub (146) may also include other types of sensors and meters, such as vibration sensors and flow meters. In accordance with one or more embodiments, the monitoring sub (146) may be powered by the electrical cable (126) and may transmit data to the surface (114) via the electrical cable (126). In accordance with one or more embodiments, the monitoring sub (146) is installed on the motor (118) and measures parameters such as pump (124) intake pressures, pump (124) discharge pressures, motor oil, winding temperature, and vibration.

The motor (118) may be a downhole submersible motor (118) that provides power to the pump (124). Specifically, the motor (118) provides the mechanical power required to drive the pump (124) via a shaft (not pictured). The motor (118) may have any configuration known in the art. For example, the motor (118) may be a two-pole, three-phase, squirrel-cage induction electric motor (118) or a permanent magnet motor. The motor's (118) operating voltages, currents, and horsepower ratings may change depending on the requirements of the operation. The size of the motor (118) is dictated by the amount of power that the pump (124) requires to lift an estimated volume of produced fluids (102) from the bottom of the well (116) to the surface (114). The motor (118) is cooled by the produced fluids (102) passing over the motor (118) housing. The motor (118) is powered by the electrical cable (126).

In accordance with one or more embodiments, the electrical cable (126) is an electrically conductive cable that is capable of transferring information. The electrical cable (126) transfers energy from the surface equipment (110) to the motor (118), the monitoring sub (146), and any other downhole equipment that requires power. The electrical cable (126) may be a three-phase electric cable that is specially designed for downhole environments. In accordance with one or more embodiments, the electrical cable (126) may be clamped to the ESP string (112) in order to limit electrical cable's (126) movement in the well (116). In other embodiments, the electrical cable (126) is freely located in the annulus (128) between the ESP string (112) and the casing string (108). In further embodiments, the ESP string (112) may also have a hydraulic line that is a conduit for hydraulic fluid. The hydraulic line may act as a sensor to measure downhole parameters such as discharge pressure from the outlet of the pump (124).

A protector (120) is located above (i.e., closer to the surface (114)) the motor (118) in the ESP string (112). The protector (120) absorbs the thrust load from the pump (124), transmits power from the motor (118) to the pump (124), equalizes pressure, provides/receives motor oil as temperature changes, and prevents produced fluids (102) from entering the motor (118). In accordance with one or more embodiments, the protector (120) houses a thrust bearing. The thrust bearing accommodates the axial thrust from the pump (124) such that the motor (118) is protected from the axial thrust. The protector isolates the motor (118) from the produced fluids (102). The protector further equalizes the pressure in the annulus (128) with the pressure in the motor (118). The annulus (128) is the space in the well (116) between the casing string (108) and the ESP string (112). The pump intake (130) is the section of the ESP string (112) where, the produced fluids (102) enter the ESP string (112) from the annulus (128).

The pump intake (130) is located above the protector (120) and below the pump (124). The depth of the pump intake (130) is designed based off of the formation (104) pressure, estimated liquid level (150) of produced fluids (102) in the annulus (128), and optimization of pump (124) performance. In accordance with one or more embodiments, the pump intake (130) is located below the liquid level (150). The liquid level (150) is the height of the liquid inside of the casing string (108). Theoretically, the ESP string (112) should be designed such that the pump intake (130) is always located below the liquid level (150) such that the pump intake (130) can always be used to intake produced fluids (102) from the annulus (128) to the pump (124).

The pump (124) is located above the pump intake (130) and lifts the produced fluids (102) to the surface (114). The pump may be a multi-stage centrifugal pump or a positive displacement pump of any suitable type known in the art. The pump (124) has a plurality of stages. Each stage contains a rotating impeller and stationary diffuser. The impeller adds energy to the fluid to provide head, whereas the diffuser converts the kinetic energy of fluid from the impeller into head. The pump (124) stages are typically stacked in series to form a multi-stage system that is contained within a pump housing. The sum of head generated by each individual stage is summative; hence, the total head developed by the multi-stage system increases linearly from the first to the last stage.

As the produced fluids (102) enter each stage, the produced fluids (102) pass through the rotating impeller to be centrifuged radially outward gaining energy in the form of velocity. The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface (114).

In other embodiments, sensors may be installed in various locations along the ESP string (112) to gather downhole data such as pump intake volumes, discharge pressures, and temperatures. The number of stages is determined prior to installation based on the estimated required discharge pressure. Over time, the formation (104) pressure may decrease and the liquid level (150) in the annulus (128) may decrease. In these cases, the ESP string (112) may be removed and resized. Once the produced fluids (102) reach the surface (114), the produced fluids (102) flow through the wellhead (134) into production equipment (136). The production equipment (136) may be any equipment that can gather or transport the produced fluids (102) such as a pipeline or a tank.

The ESP system may include an SSSV (142) installed within the ESP string (112). The SSSV (142) may be installed near the surface (114). The SSSV (142) is a valve, such as a flapper valve, that may be used to block the produced fluids (102) from flowing up the ESP string (112) and to the surface (114).

The SSSV (142) may be used as part of the shut-in system of the well (116). In scenarios where the well (116) needs to be shut in, such as for repairs or in an emergency, the SSSV (142) along with other valves located in the wellhead (134) are closed. The SSSV (142) may be controlled using a SSSV control line (144). The SSSV control line (144) may connect the SSSV (142) to a control module at the surface (114). The SSSV control line (144) may be a conduit for hydraulic fluid. The control module may use the hydraulic fluid, within the SSSV control line (144), to open or close the SSSV (142).

In accordance with one or more embodiments, the packer (148) is located above the pump (124) and liquid level (150) and below the SSSV (142). The packer (148) is located outside the ESP string (112) and within the casing string (108). The packer (148) seals against the casing string (108) to seal off the annulus (128). Specifically, the packer (148) prevents produced fluids (102) or separated gas (132) from migrating below the packer (148) to above the packer (148). The packer (148) may be any type of packer (148) known in the art, such as a mechanical packer, a hydraulic packer, a mono-bore packer, or a multi-bore packer.

The remainder of the ESP system (100, 200) includes various surface equipment (110) such as electric drives (137), pump control equipment (138), the control module, and an electric power supply (140). The electric power supply (140) provides energy to the motor (118) through the electrical cable (126). The electric power supply (140) may be a commercial power distribution system or a portable power source such as a generator.

The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

As outlined above, FIG. 1 shows an ESP system (100) that does not include a bypass and FIG. 2 shows an ESP system (200) that does include a bypass. In accordance with one or more embodiments, the bypass in the ESP system (200) of FIG. 2 allows tools to be run into the well (116) past the ESP string (112) using a Y-tool (202). The Y-tool (202), allows two sections of fluid path to the production tubing (152) above it. The first section is a through leg (204) that allows tools to be run downhole for logging, simulation, and general access to the formation (104) below the ESP string (112).

The second section includes the ESP string (112). The through leg (204) and the ESP string (112) run parallel to one another into the well (116). Prior to production, a blanking plug (206) is inserted in the through leg (204) to prevent fluid recirculation downstream of the ESP string (112) during operation. When access to the formation (104) is desired, the blanking plug (206) may be removed to perform the require operation below the ESP string (112). The ESP systems (100, 200) outlined above are not meant to be limiting and are used to show the variety of systems in which the present disclosure may be applied.

In both of the ESP systems (100, 200) shown in FIGS. 1 and 2, the produced fluids (102) may include associated gas. If the produced fluids (102) have associated gas, then a gas separator may be installed in the ESP string (112) above the pump intake (130) but below the pump (124). The gas separator removes the gas from the produced fluids (102) and injects the separated gas (132) into the annulus (128). It is important to note that with conventional technologies, a gas separator is not able to be installed in an ESP system (100, 200) if there is also a packer (148). This is because a gas separator may cause premature gas-lock from accumulated gases.

In further embodiments, the separated gas (132) may naturally separate from the produced fluids (102). Specifically, as the produced fluids (102) flow from the formation (104) into the interior of the well (116), natural separation occurs between the associated gas and the other liquids within the produced fluids (102). Upon separation, the separated gas (132) rises to the top of the annulus (128) below the packer (148).

Over prolonged production periods, the separated gas (132) accumulation increases to create a distinct interface between the gas and liquid phases. The liquid level (15) decreases with prolonged production. This separated gas (132) may begin to accumulate between the pump intake (130) and the packer (148) overtime, which creates a challenge in production operations. The accumulated separated gas (132) may corrode the electrical connections below the packer (148) leading to failure of the ESP string (112). This may cause the operator to incur deferred production and higher workover expenses, amongst others. Furthermore, the liquid level (150) decreasing towards the pump intake (130) may result in pump-off conditions, where the pump (124) ingests separated gas (132) causing erratic operation, instability, pump performance deterioration, and eventually potential failure.

The above challenges are mitigated in conventional applications using gas vent valves. The gas vent valve enables both packers (148) and packers (148) to be installed in an ESP system (100) as the gas vent valves can prevent gas-lock. In these systems, a gas vent valve is connected to a hydraulic line and is operated from the surface (114). When separated gas (132) accumulates, hydraulic pressure is applied from surface to open the gas vent valve and bleed or vent the gas into the annulus region above the packer (148). After venting, the surface pressure is removed, the gas vent valve closes, and production continues.

One limitation of the conventional system is that it relies on human intervention to operate the gas vent valve. Furthermore, applying hydraulic pressure from surface requires the use of high-pressure pumps to overcome the high downhole pressures caused by the liquid column to open the gas vent valve downhole. Furthermore, in certain jurisdictions, separated gas (132) cannot be vented into the annulus (128) region above the packer (148) to maintain well completion integrity. As such, the conventional method of venting cannot be applied in these jurisdictions. The present disclosure overcomes these limitations by providing a gas activated vent valve (300) just below the packer (148) that is activated by the pressure of the separated gas (132) and is connected to a vent line (302) to transport the separated gas (132) to the surface (114). On the surface (114), the separated gas (132) may be processed accordingly or stored for sale or other operational purposes.

Figure 3B:
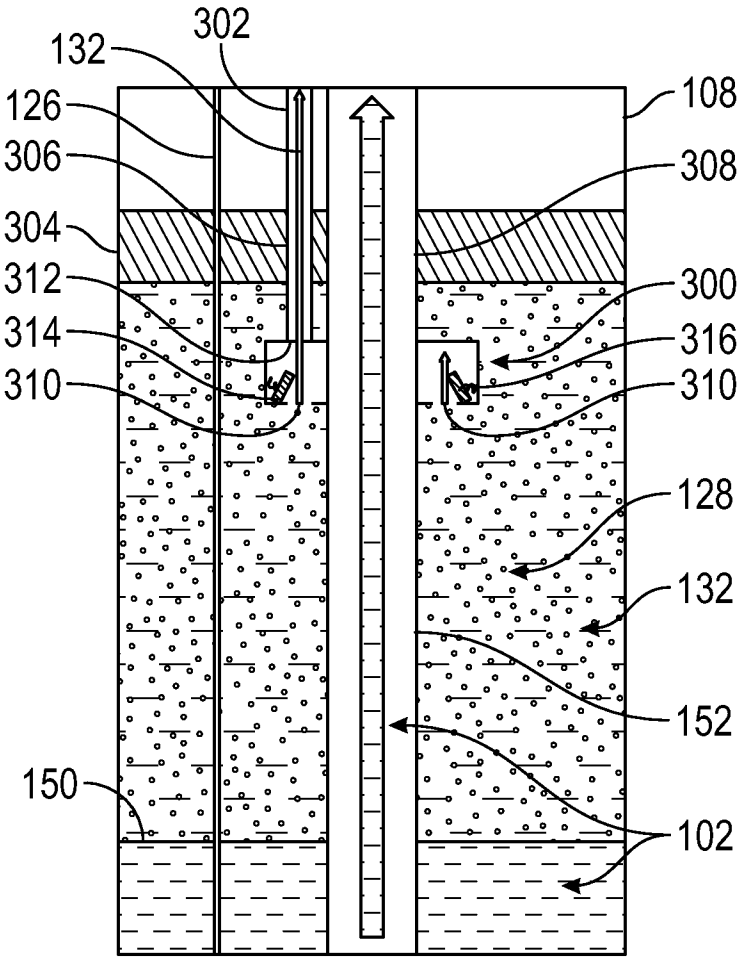
FIGS. 3*a* and 3*b* show a gas activated vent valve installed in an ESP system having a multi-bore packer in accordance with one or more embodiments.
Figure 3A:
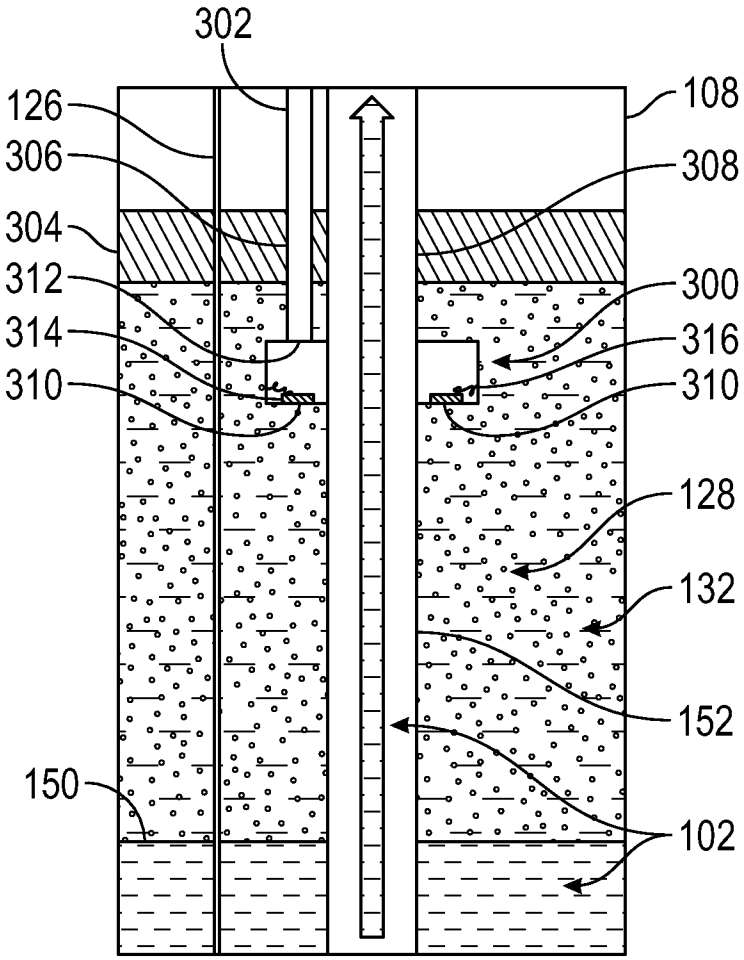

FIGS. 3*a*-4*b* show a gas activated vent valve (300) in accordance with one or more embodiments. Specifically, FIGS. 3*a* and 3*b* show the gas activated vent valve (300) installed in an ESP system (100, 200) having a multi-bore packer (304). Components shown in FIGS. 3*a* and 3*b* that are the same as or similar to components shown in FIGS. 1 and 2 have not be re-described for purposes of readability and have the same description and function as outlined above. FIG. 3*a* shows the gas activated vent valve (300) in a closed position, and FIG. 3*b* shows the gas activated vent valve (300) in an open position.

FIGS. 3*a* and 3*b* show the production tubing (152) deployed in the casing string (108). While not shown, it can be inferred that the production tubing (152) is connected to an ESP string (112) downhole. A multi-bore packer (304) is connected to the production tubing (152) and is sealed against the internal circumferential surface of the casing string (108). The multi-bore packer (304) may be similar to or the same as the packer (148) outlined above in FIGS. 1 and 2. A multi-bore packer (304) is specially designed to allow for multiple bores passing through the interior of the packer. The multi-bore packer (304) shown in FIGS. 3*a* and 3*b* has a first bore (306) and a second bore (308).

As shown in FIGS. 3*a* and 3*b*, the multi-bore packer (304) is designed to allow the production tubing (152) and the vent line (302) to pass through the packer. Specifically, the vent line (302) is disposed in the first bore (306) and the production tubing (152) is disposed in the second bore (308). Thus, the multi-bore packer (304) seals between the vent line (302), production tubing (152), and casing string (108). That is, the sealing aspect of the multi-bore packer (304) prevents fluids from migrating from the annulus (128) located below the multi-bore packer (304) to the annulus (128) located above the multi-bore packer (304). In other words, fluids are only able to pass through the multi-bore packer (304) via the vent line (302) or the production tubing (152).

FIGS. 3*a* and 3*b* show the liquid level (150) designating the separation of produced fluids (102) and separated gas (132). As can be seen, the separated gas (132) accumulates above the liquid level (150) and below the multi-bore packer (304). The separated gas (132) may accumulate below the multi-bore packer (304) due to natural separation or via a gas separator located in the ESP string (112).

The gas activated vent valve (300) is installed on the production tubing (152) below the multi-bore packer (304). The gas activated vent valve (300) is shown above the liquid line (302) in FIGS. 3*a* and 3*b*, however, a person skilled in the art will appreciate that the gas activated vent valve (300) may be initially located within the produced fluids (102). In this scenario, the liquid level (150) may lower over time, eventually causing the gas activated vent valve (300) to be located above the liquid level (150) and within the separated gas (132).

In further embodiments, the gas activated vent valve (300) may be located at or connected to the bottom surface of the multi-bore packer (304) without departing from the scope of the disclosure herein. In accordance with one or more embodiments, the wetted parts of the gas activated vent valve (300) may be made from materials that are corrosion and abrasion resistant. The surface of the gas activated vent valve (300) may be treated with anti-scale adherence material or other appropriate treatments to ensure solid operation flow assurance.

The gas activated vent valve (300) is connected to the vent line (302). The vent line (302) extends from the gas activated vent valve (300), through the multi-bore packer (304), and to the surface (114). The vent line (302) is fluidically connected to the gas activated vent valve (300) such that the separated gas (132) may travel from the gas activated vent valve (300) to the vent line (302) when the gas activated vent valve (300) is in the open position, as shown in FIG. 3*b*.

The vent line (302) is also fluidically connected to equipment at the surface (114) such that the separated gas (132) may travel from the vent line (302) to the equipment at the surface (114). The vent line (302) or the equipment at the surface (114) may also have valves thereon that control the flow of separated gas (132) from the vent line (302) to the equipment. The equipment at the surface may be any equipment known in the art, such as storage tanks, flare stacks, etc.

The gas activated vent valve (300) has a gas inlet (310) and a gas outlet (312). The gas inlet (310) is situated so as to be in contact with the separated gas (132) located below the multi-bore packer (304). The gas outlet (312) is connected to the vent line (302). The gas activated vent valve (300) is normally in the closed position, as shown in FIG. 3*a*. That is, the gas inlet (310) is normally closed such that the separated gas (132) is unable to pass through the gas inlet (310) to the gas outlet (312). The gas activated vent valve (300) may be configured in a myriad of ways that allow the pressure of the separated gas (132) pushing on the gas activated vent valve (300) to open the gas inlet (310) and allow the separated gas (132) to flow from the gas inlet (310) to the gas outlet (312) and, subsequently, into the vent line (302).

FIGS. 3*a* and 3*b* show the gas activated vent valve (300) operating using a flapper (314) and a spring (316). The flapper (314) is situated across the gas inlet (310) and the spring (316) holds the flapper (314) against the gas inlet (310). The flapper (314) being held against the gas inlet (310) causes the gas activated vent valve (300) to be in the closed position, as shown in FIG. 3*a*. The spring (316) is sized for the specific application based on setting depth, setting depth pressure, etc. as is typically accomplished by best-practice engineering.

During operation, as the separated gas (132) accumulates above the liquid level (150), a cracking pressure is reached. Once the cracking pressure is reached, the upward force on the spring (316) caused by the pressure of the separated gas (132) is just greater than the downward force caused by the spring (316). As the pressure of the separated gas (132) exceeds cracking pressure, the flapper (314) is pushed open and the separated gas (132) flows from the gas inlet (310) through the gas outlet (312) into the vent line (302) and continues to the surface (114), as shown in FIG. 3*b*. Once the pressure in the accumulated separated gas (132) region decreases to a pressure below the cracking pressure, the downward force of the spring (316) becomes greater than the pressure exerted on the spring (316) by the separated gas (132). This causes the flapper (314) to close against the gas inlet (310), as shown in FIG. 3*a*. The process can be repeated automatically as described, as many times as possible, without human intervention.

FIGS. 3*a* and 3*b* show one example of how the gas activated vent valve (300) may operate, however, a person skilled in the art will appreciate that the gas activated vent valve (300) using any technology known in the art that allows a valve to open based on pressure seen across the valve. For example, the gas activated vent valve (300) may operate using a sliding sleeve, bellows, etc. Furthermore, FIGS. 3*a* and 3*b* show one configuration of how the gas activated vent valve (300) may operate using a spring (316), however a person skilled in the art will appreciate any configuration that uses a spring to prevent separated gas from flowing into the vent line (302) may be used without departing from the scope of the disclosure herein. For example, the spring (316) may hold the flapper (314) against the gas outlet (312), rather than the gas inlet (310).

Figure 4B:
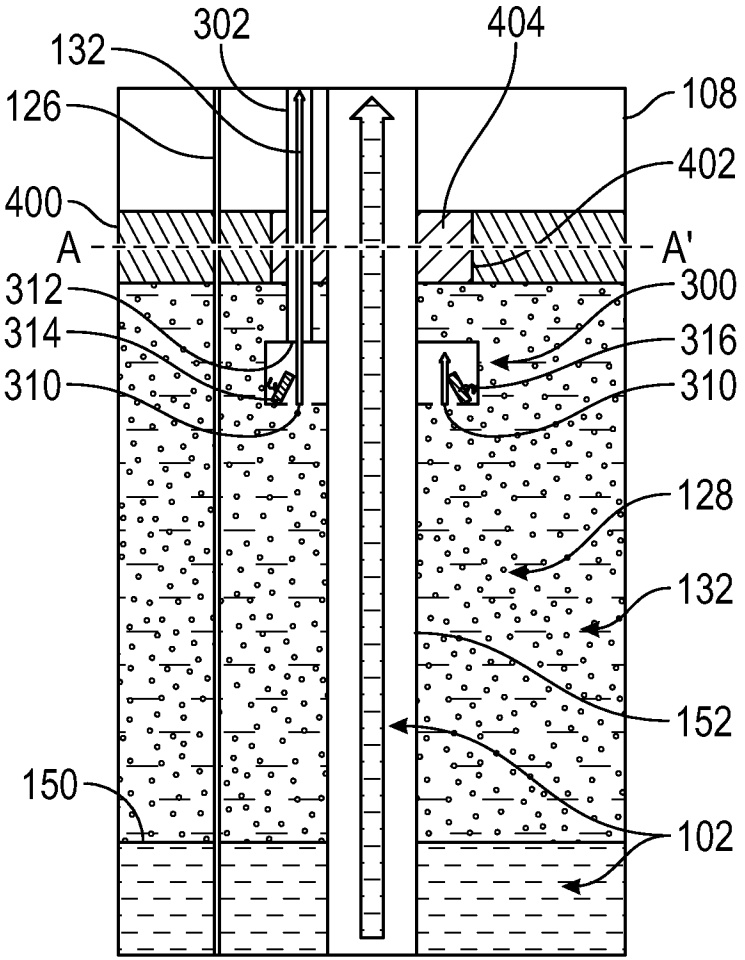
FIGS. 4*a* and 4*b* show the gas activated vent valve installed in an ESP system having a mono-bore packer in accordance with one or more embodiments.
Figure 4A:
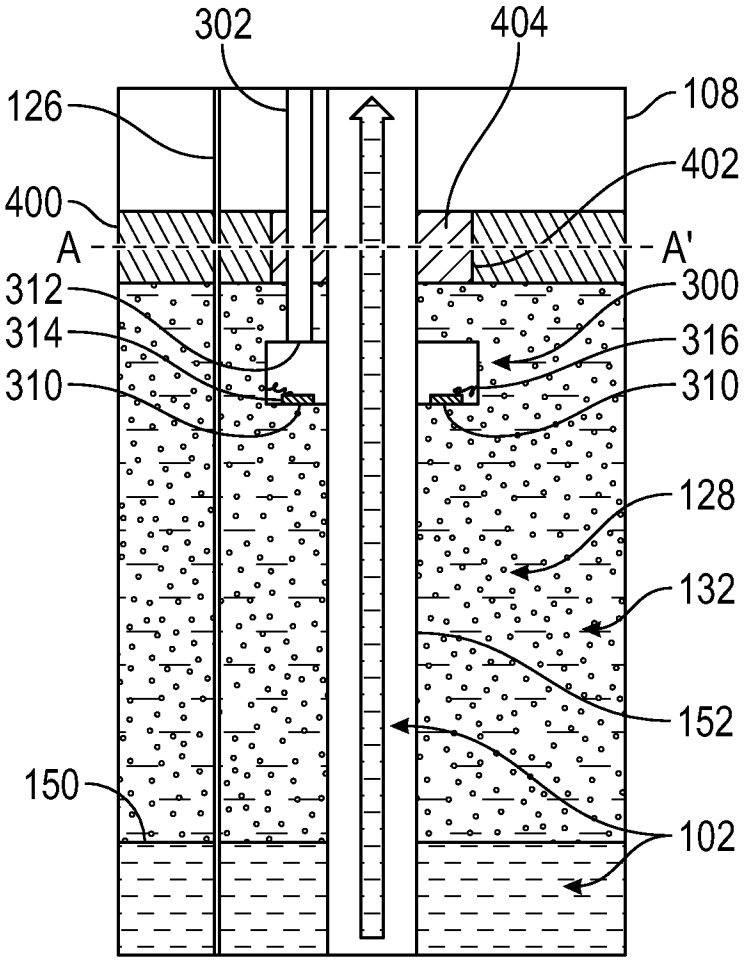
Figure 5:
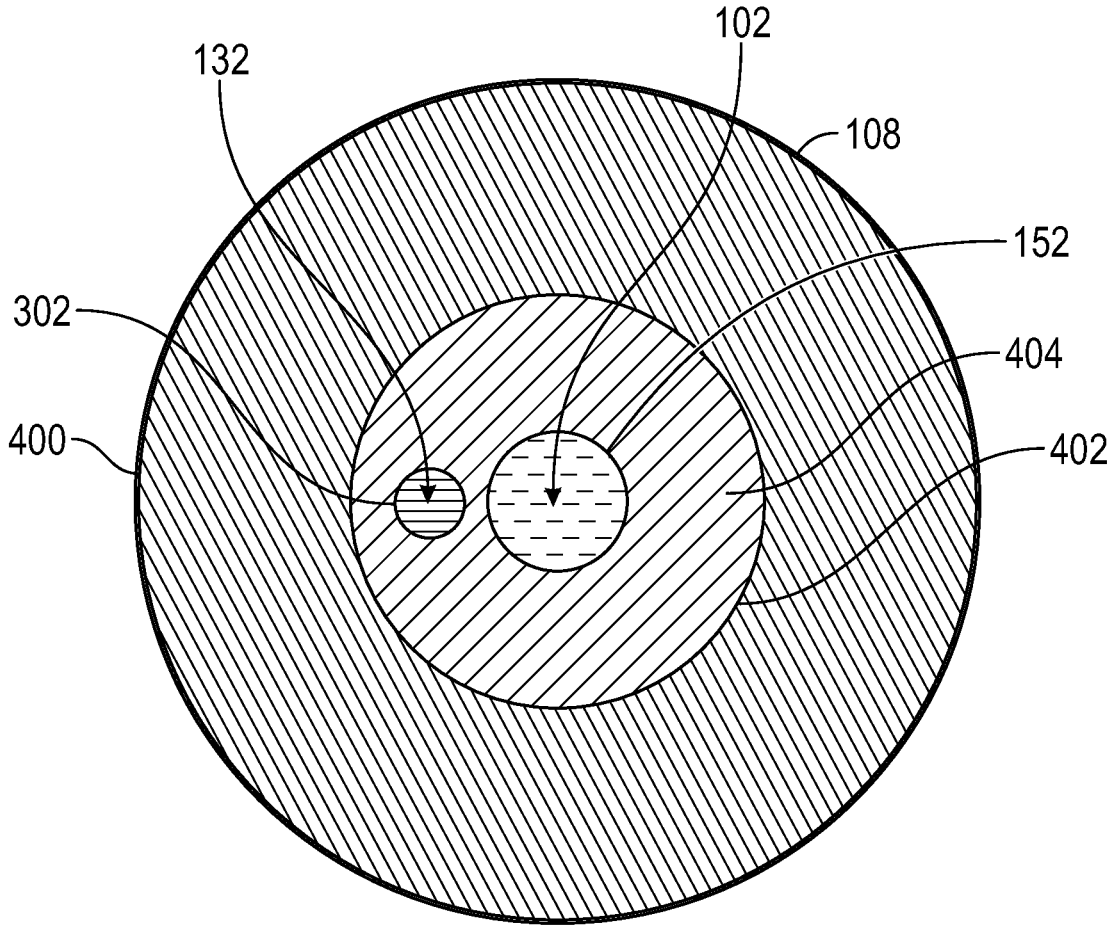
FIG. 5 shows a cross section of the mono-bore packer (400) shown in FIGS. 4*a* and 4*b* in accordance with one or more embodiments.

FIGS. 4*a*-5 show the gas activated vent valve (300) installed in an ESP system (100, 200) having a mono-bore packer (400). Components shown in FIGS. 4*a*-5 that are the same as or similar to components shown in FIGS. 1-3*b* have not be re-described for purposes of readability and have the same description and function as outlined above. FIG. 4*a* shows the gas activated vent valve (300) in a closed position, and FIG. 4*b* shows the gas activated vent valve (300) in an open position. FIG. 5 shows a cross section of FIGS. 4*a* and 4*b* along line A-A'.

The design of the gas activated vent valve (300) and the general system shown in FIGS. 4*a* and 4*b* is the same as that shown in FIGS. 3*a* and 3*b*, respectively. The only difference is the type of packer shown. FIGS. 3*a* and 3*b* show a multi-bore packer (304) whereas FIGS. 4*a* and 4*b* show a mono-bore packer (400). A mono-bore packer (400) is a packer with a single bore (402). As such, to run the vent line (302) and the production tubing (152) through the single bore (402), while keeping the seal's integrity, an adapter (404) may be run. The adapter (404) may be machined specifically for the size of the single bore (402) in the mono-bore packer (400) and the size of the vent line (302) and the production tubing (152). The mono-bore packer (400) may be the same as or similar to the packer (148) shown in FIGS. 1 and 2.

The adapter (404) may be made out of any material known in the art and may be made out of the same material as the mono-bore packer (400). As shown in FIGS. 4*a*-5, the vent line (302) and the production tubing (152) may be embedded in the adapter (404). In other embodiments, the adapter (404) may be configured such that the vent line (302) and the production tubing (152) are each divided into a top end that extends above the adapter (404) and a bottom end that extends below the adapter (404) towards the gas activated vent valve (300). In such embodiments, the top ends would be threaded into the top end of the adapter (404) and the bottom ends would be threaded into the bottom ends of the adapter (404).

Figure 6:
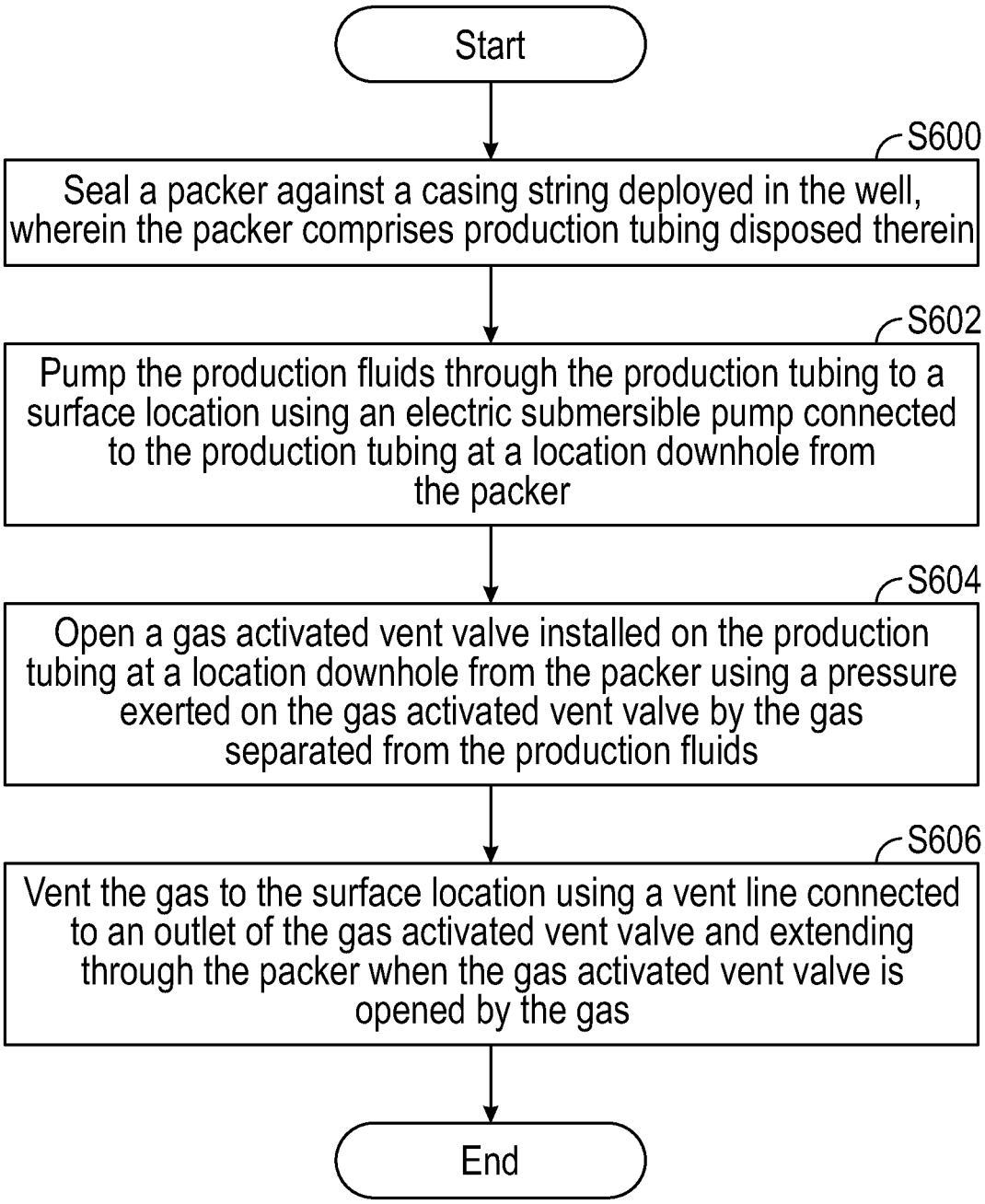
FIG. 6 shows a flowchart in accordance with one or more embodiments.

FIG. 6 shows a flowchart in accordance with one or more embodiments. The flowchart outlines a method for venting gas (e.g., separated gas (132)) separated from produced fluids (102) located in a well (116). While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S600, a packer is sealed against a casing string (108) deployed in the well (116), and the packer comprises production tubing (152) disposed therein. In accordance with one or more embodiments, the packer may be the multi-bore packer (304) outlined in FIGS. 3*a* and 3*b* or the mono-bore packer (400) outlined in FIGS. 4*a*-5. In accordance with one or more embodiments the multi-bore packer (304) or the mono-bore packer (400) may be disposed on the production tubing (152) and the production tubing (152) may be run into the well (116). Once the multi-bore packer (304)/mono-bore packer (400) has been lowered to the correct depth in the well (116), the multi-bore packer (304)/mono-bore packer (400) may be activated to seal against the casing string (108). The multi-bore packer (304)/mono-bore packer (400) may be activated using any method known in the art and depending on the construction of the multi-bore packer (304)/mono-bore packer (400). For example, the multi-bore packer (304)/mono-bore packer (400) may be activated mechanically, using compression or hydraulically, using hydraulic fluid.

In S602, the produced fluids (102) are pumped through the production tubing (152) to a surface (114) location using an electric submersible pump (124) connected to the production tubing (152) at a location downhole from the packer. In accordance with one or more embodiments, the pump (124) may be part of an ESP string (112). The ESP string (112) may be installed into the well (116) as part of an ESP system (200) that has a bypass, such as the ESP system (200) shown in FIG. 2. In other embodiments, the ESP string (112) may be installed in the well (116) as part of an ESP system (100) that does not have a bypass, such as the ESP system (100) shown in FIG. 1.

In S604, a gas activated vent valve (300) installed on the production tubing (152) at a location downhole from the packer is opened using a pressure exerted on the gas activated vent valve (300) by the gas separated from the produced fluids (102). In accordance with one or more embodiments, the gas separated from the produced fluids (102) may be the separated gas (132) outlined above in FIGS. 1-5. In further embodiments, the gas activated vent valve (300) has an open position (as shown in FIGS. 3*b* and 4*b*) and a closed position (as shown in FIGS. 3*a* and 4*a*).

The closed position may be caused by a spring (316). The spring (316) may be pressing a flapper (314) against a gas inlet (310) of the gas activated vent valve (300) to keep the gas inlet (310) closed. The spring (316) has a cracking pressure, which is the pressure required to overcome the force of the spring (316). Thus, as the separated gas (132) builds up beneath the packer, the pressure of the separated gas (132) may exceed the cracking pressure. When this happens, the separated gas (132) is able to push the flapper (314) and open the gas inlet (310) of the gas activated vent valve (300).

In S606, the gas is vented to the surface (114) location using a vent line (302), connected to a gas outlet (312) of the gas activated vent valve (300) and extending through the packer, when the gas activated vent valve (300) is opened by the gas. In accordance with one or more embodiments, when the separated gas (132) overcomes the cracking pressure of the spring (316), the gas inlet (310) of the gas activated vent valve (300) opens and the separated gas (132) is able to flow to the gas outlet (312) of the gas activated vent valve (300). From the gas outlet (312), the separated gas (132) is able to flow past the packer via the vent line (302). The vent line (302) may extend to the surface (114) and the separated gas (132) may flow to the surface (114) via the vent line (302).

As outlined above, the packer may be the multi-bore packer (304) outlined in FIGS. 3*a* and 3*b* or the mono-bore packer (400) outlined in FIGS. 4*a*-5. If the packer is the multi-bore packer (304), then the multi-bore packer (304) comprises a first bore (306) and a second bore (308). The vent line (302) is disposed in the first bore (306) and the production tubing (152) is disposed in the second bore (308). If the packer is the mono-bore packer (400), then the mono-bore packer (400) comprises a single bore (402). An adapter (404) may be machined to fit within the single bore (402) and the adapter (404) may be installed in the single bore (402) of the mono-bore packer (400). The production tubing (152) and the vent line may extend through the adapter (404).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for venting gas separated from production fluids located in a well, the system comprising:

a packer sealed against a casing string deployed in the well;

production tubing extending through the packer, wherein the production tubing is configured to transport the production fluids to a surface location;

an electric submersible pump connected to the production tubing at a location downhole from the packer, wherein the electric submersible pump is configured to pump the production fluids through the production tubing;

a gas activated vent valve installed on the production tubing at a location downhole from the packer and configured to open using a pressure exerted on the gas activated vent valve by the gas; and a vent line connected to an outlet of the gas activated vent valve, extending through the packer, and configured to transport the gas from the gas activated vent valve to the surface location when the gas activated vent valve is opened by the gas.

2. The system of claim 1, wherein the gas activated vent valve comprises a spring configured to keep the gas activated vent valve closed.

3. The system of claim 2, wherein the gas activated vent valve comprises a flapper configured to be pressed against an inlet of the gas activated vent valve via the spring.

4. The system of claim 3, wherein the gas activated vent valve is configured to open when the pressure exerted on the flapper of the gas activated vent valve exceeds a cracking pressure of the spring.

5. The system of claim 1, wherein the packer further comprises a multi-bore packer.

6. The system of claim 5, wherein the multi-bore packer comprises a first bore and a second bore.

7. The system of claim 6, wherein the vent line is disposed within the first bore of the multi-bore packer and the production tubing is disposed within the second bore of the multi-bore packer.

8. The system of claim 1, wherein the packer further comprises a mono-bore packer.

9. The system of claim 8, wherein an adapter is disposed within a single bore of the mono-bore packer.

10. The system of claim 9, wherein the vent line and the production tubing extend through the adapter.

11. A method for venting gas separated from production fluids located in a well, the method comprising:

sealing a packer against a casing string deployed in the well, wherein the packer comprises production tubing disposed therein;

pumping the production fluids through the production tubing to a surface location using an electric submersible pump connected to the production tubing at a location downhole from the packer;

opening a gas activated vent valve installed on the production tubing at a location downhole from the packer using a pressure exerted on the gas activated vent valve by the gas separated from the production fluids; and venting the gas to the surface location using a vent line connected to an outlet of the gas activated vent valve and extending through the packer when the gas activated vent valve is opened by the gas.

12. The method of claim 11, further comprising closing the gas activated vent valve using a spring.

13. The method of claim 12, wherein closing the gas activated vent valve further comprises pressing a flapper against an inlet of gas activated vent valve using the spring.

14. The method of claim 13, wherein opening the gas activated vent valve further comprises exerting the pressure on the flapper of the gas activated vent valve to exceed a cracking pressure of the spring.

15. The method of claim 11, wherein sealing the packer against the casing string further comprises sealing a multi-bore packer against the casing string.

16. The method of claim 15, further comprising extending the vent line through a first bore of the multi-bore packer.

17. The method of claim 16, further comprising extending the production tubing through a second bore of the multi-bore packer.

18. The method of claim 11, wherein sealing the packer against the casing string further comprises sealing a mono-bore packer against the casing string.

19. The method of claim 18, further comprising installing an adapter into a single bore of the mono-bore packer.

20. The method of claim 19, further comprising extending the vent line and the production tubing through the adapter.

* * * * *